US005845499A

United States Patent [19]

Montesanto

[11] Patent Number: 5,845,499

[45] Date of Patent: Dec. 8, 1998

[54] BEVERAGE CHILLING AND INSULATING DEVICE

[76] Inventor: Michael Montesanto, 31 Gaviota, Rancho Santa Morgarita, Calif. 92688

[21] Appl. No.: 62,919

[22] Filed: Apr. 20, 1998

[51] Int. Cl.[6] ..... F17C 7/04

[52] U.S. Cl. ..... 62/48.1; 62/294; 62/529; 62/457.4

[58] Field of Search ..... 62/293, 294, 457.4, 62/373, 48.1, 45.1, 529, 530, 531, 457.1

[56] References Cited

U.S. PATENT DOCUMENTS 4,054,037 10/1977 Yoder ..... 62/530
4,711,099 12/1987 Polan et al. ..... 62/293

*Primary Examiner*—John M. Sollecito
*Attorney, Agent, or Firm*—Goldstein & Canino

[57] ABSTRACT

A beverage chilling and insulating device comprising an insulated sleeve for accepting a beverage container such as a beer or soda can. The insulated sleeve is secured at a bottom end to an insulated hollow base which defines a chilling chamber, the chilling chamber in communication with the sleeveway. A cartridge receptacle hole is located upon the insulated hollow base and extends inward into the insulated hollow base to form a cylindrical cartridge chamber. A needle valve protrudes from the cartridge chamber into the chilling chamber. A pressurized refrigerant cartridge which contains a volume of pressurized refrigerant such as freon or liquid nitrogen is inserted into the cartridge chamber until the needle valve punctures the cartridge, allowing the pressurized refrigerant contents to escape from the cartridge, through the needle valve into the chilling chamber and sleeveway. The refrigerant then lowers the temperature of the beverage container which is encapsulated within the sleeveway, the beverage container maintained at this decreased temperature for an extended period of time by the insulative properties of the insulated wall.

3 Claims, 3 Drawing Sheets

BEVERAGE CHILLING AND INSULATING DEVICE

FIELD OF THE INVENTION

The invention relates to an improved beverage chiller and insulator. More particularly, the present invention relates to a device which is capable of accepting a beverage container such as a beer or soda can, rapidly chilling said beverage container by means of a disposable pressurized refrigerant gas container, and then keeping said beverage container insulated for an extended period of time.

BACKGROUND OF THE INVENTION

Consumers of cold beverage products such as beer, soda, juice and the like often find that their enjoyment of these products is diminished by the fact that these beverages quickly absorb heat from their external environment and loose their "chill" and thus enjoyable cool refreshment. Devices are found in the art which successfully maintain a beverage's low cool temperature through insulative means. For example, cold beverages (as well as hot beverages) are often placed within a traditional glass thermos to retain the beverage's low temperature and prevent the effects of external heat thereupon. These glass thermoses often prove bulky, expensive and delicate however, and are thus not widely used to maintain low temperatures of small volumes of cold beverages.

As a supposed solution to this problem, foam insulative collars were developed which are wrapped around a beverage container in an attempt to keep the liquid contents therein cool. While these foam collars do indeed maintain a cool temperature of the beverage container for a short period of time, they fail to address, as do other products found heretofore in the art, the situation where the beverage container has already lost it's cool temperature. Once a beverage container has absorbed heat and it's temperature been raised above that which provides refreshing consumption, insulation at that point is fruitless. None of these above mentioned devices provides for a means of re-chilling a beverage. A device is needed which allows a beverage to be brought back to and maintained at a cool temperature when the consumer of the beverage lacks access to traditional cooling means such as electrical refrigeration, ice, etc. The improved beverage chiller and insulator of the instant invention provides such a means.

SUMMARY OF THE INVENTION

The present invention relates to a device which is capable of accepting a beverage container such as a beer or soda can, rapidly chilling said beverage container by means of a disposable pressurized refrigerant gas container, and then keeping said beverage container insulated for an extended period of time.

In accordance with the invention, there is provided a beverage chilling and insulating device which allows the temperature of a containerized beverage to be rapidly decreased when traditional means for decreasing temperature are unavailable.

Further in accordance with the invention, there is provided a beverage chilling and insulating device which, upon decreasing the temperature of a containerized beverage is also capable of maintaining said decreased temperature for an extended period of time.

Further in accordance with the invention, there is provided a beverage chilling and insulating device which is simplistic in design and manufacture, and relatively inexpensive to manufacture.

Further in accordance with the invention, there is provided a beverage chilling and insulating device which is suitable for use at sporting events, camping trips, automobile journeys and other situations where a cool beverage might potentially increase in temperature and need to be re-chilled quickly and easily.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
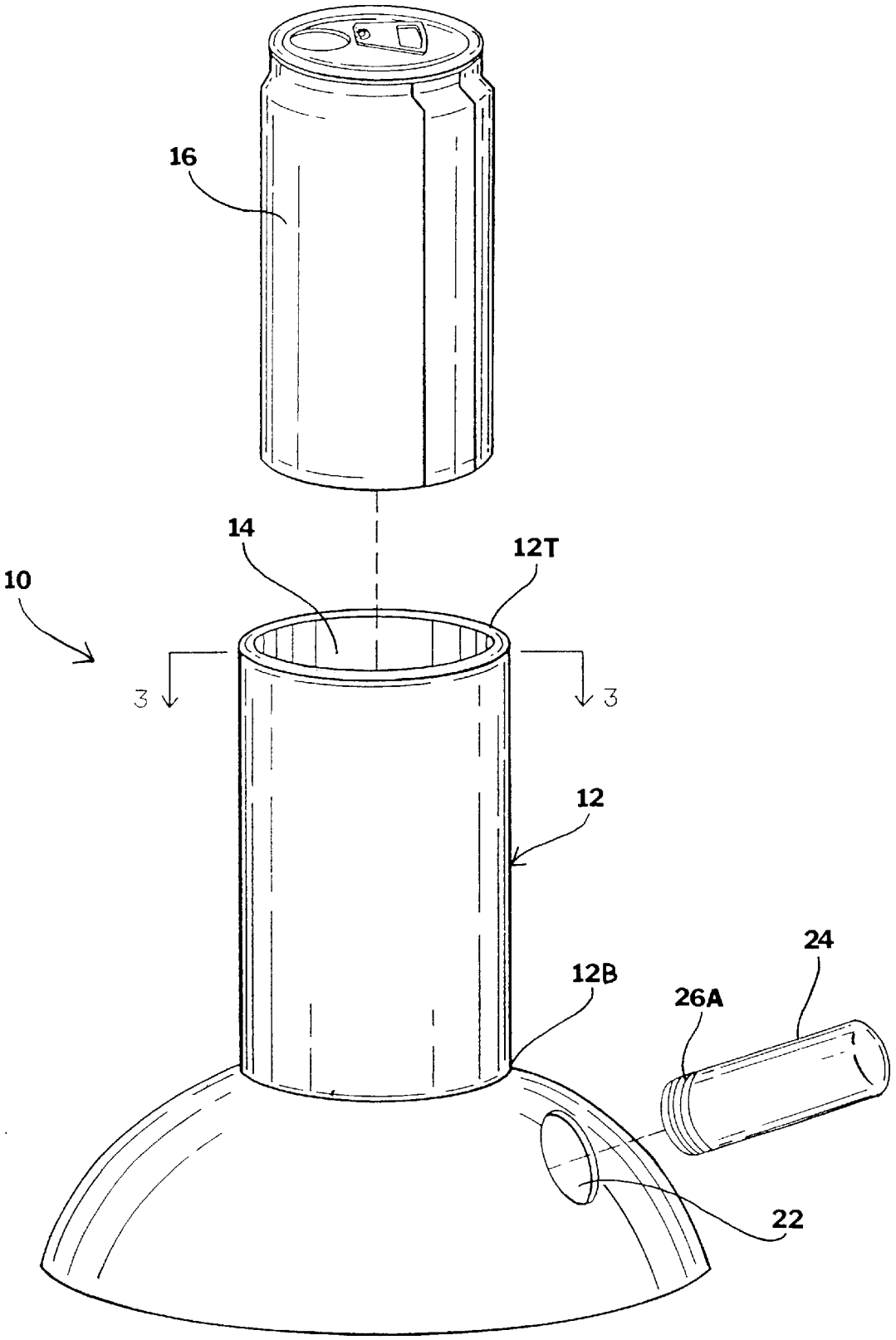
FIG. 1 is a diagrammatic perspective view of an improved beverage chilling and insulating device of the instant invention, with a beverage container being inserted into a sleeveway thereof.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the beverage chilling and insulating device. The words "proximal end" and "distal end" refer, respectively, to ends of an object nearer to and further from the operator of the object when the object is used in a normal fashion or as is described in the specification.

FIG. 1 illustrates a beverage chilling and insulating device 10 of the instant invention. The beverage chilling and insulating device 10 comprises an insulated sleeve 12 as shown. The insulated sleeve is preferably comprised of polystyrene or similar foam having strong thermal insulative qualities. The insulated sleeve 12 defines a sleeveway 14 in the center thereof, which is sized to accept a standard beverage container 16 such as a beer or soda can. While the insulated sleeve 12 of FIG. 1 is represented as cylindrical, it is also contemplated that said insulated sleeve 12 be rectangular, triangular or any other shape capable of accepting a beverage container 16 and retaining it tightly within the sleeveway 14 thereof.

Figure 2:
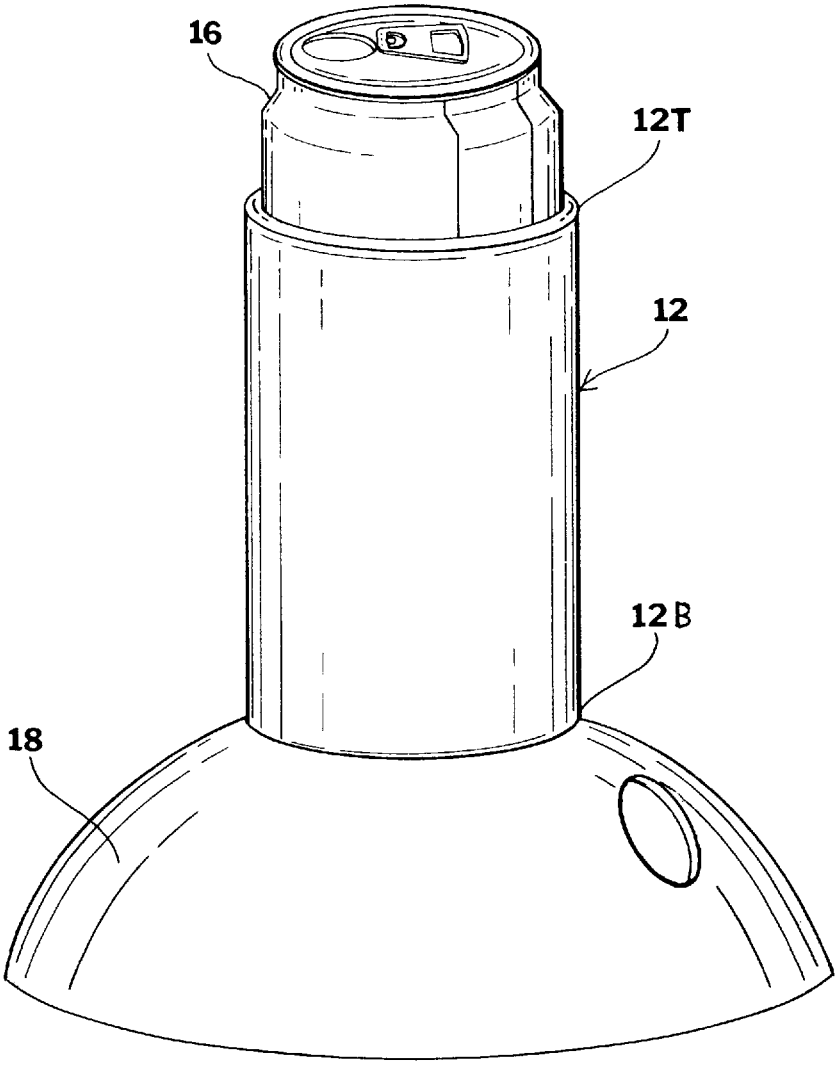
FIG. 2 is a diagrammatic perspective view of the improved beverage chilling and insulating device of FIG. 1, with the beverage container shown partially encapsulated within the sleeveway.

The insulated sleeve 12 further has a top end 12T and a bottom end 12B. The top end 12T is open, allowing access to the sleeveway 14 so that the beverage container 16 may be inserted therein, as can be seen in FIG. 2. The bottom end 12B of the insulated sleeve 12 has an insulated hollow base 18 secured thereto, as can be seen clearly with reference to FIGS. 2 and 3. The insulated hollow base 18 defines a chilling chamber 20, said chilling chamber 20 in communication with the sleeveway 14 of the insulated sleeve 12. A cartridge receptacle hole 22 is located upon the insulated hollow base 18 for receiving a pressurized refrigerant cartridge 24 such as that seen in FIG. 1. The pressurized refrigerant cartridge 24 contains a high volume of pressurized material such as liquid nitrogen or gaseous freon. The pressurized refrigerant cartridge 24 is elongated and cylindrical in shape, having opposite ends. A series of threads 26A are inscribed upon one of said ends, for reasons which will become apparent below.

Figure 3:
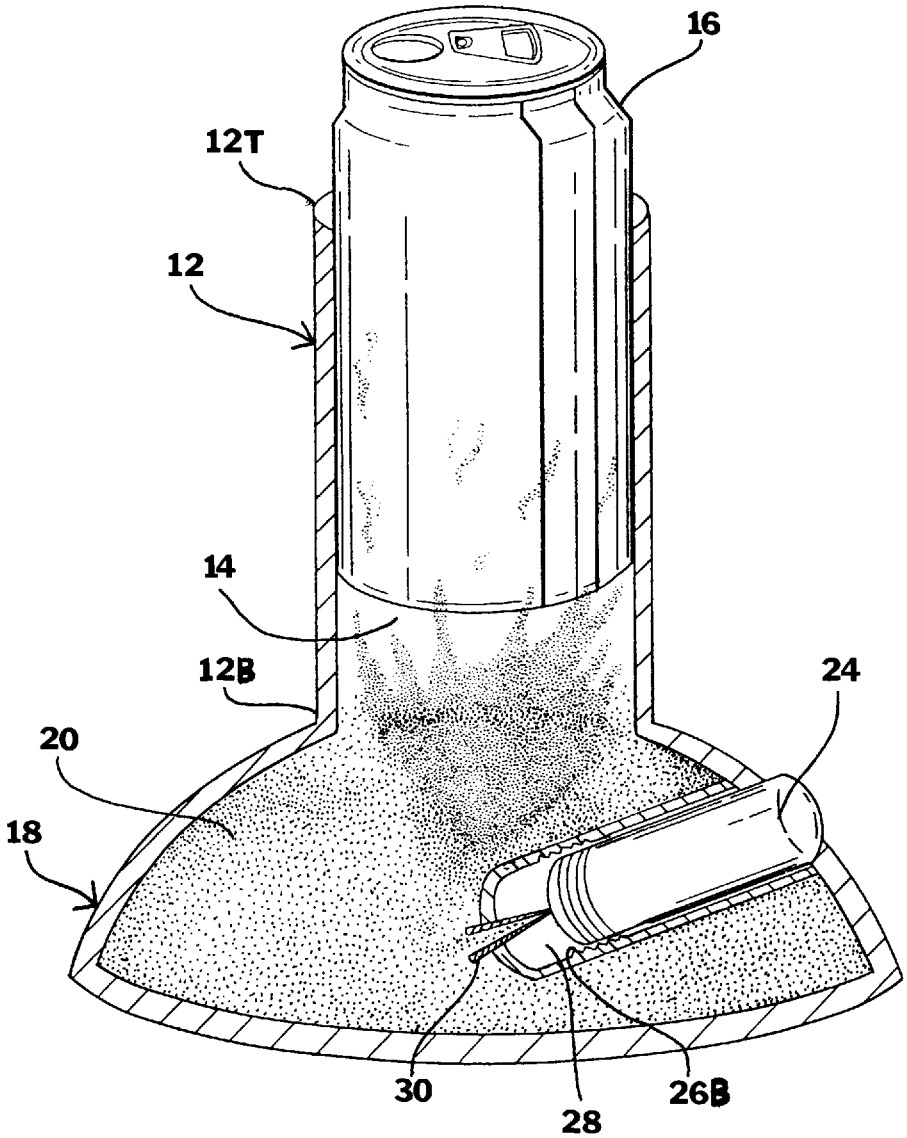
FIG. 3 is a cross sectional view of the improved beverage chilling and insulating device, taken along line 3—3 of FIG. 1.

The cartridge receptacle hole 22 is in communication with a cartridge chamber 28, said cartridge chamber 28 extending into the chilling chamber 20. The cartridge chamber 28 is elongated and cylindrical in shape, sized slightly larger than the pressurized refrigerant cartridge 24 so that it may accept said pressurized refrigerant cartridge 24 therein, as seen in FIG. 3. A series of threads 26B which correspond to the threads 26A of the pressurized refrigerant cartridge 24 are disposed along the inside of the cartridge chamber 28, so that the pressurized refrigerant cartridge 24 may be firmly engaged thereto. A needle valve 30 is located in the cartridge chamber 28 opposite the cartridge receptacle hole 22, said needle valve extending from the cartridge chamber 28 into the chilling chamber 20. Upon engagement of the pressurized refrigerant cartridge 24 into the cartridge chamber 28, the needle valve 30 punctures the pressurized refrigerant cartridge 24, allowing the pressurized refrigerant contained therein to escape from the pressurized refrigerant cartridge 24, through the needle valve 30 and into the chilling chamber 20.

The instant invention is operated by inserting a beverage container 16 into the sleeveway 14 of the insulated wall 12 so that the bottom region of said beverage container 16 is positioned proximal to the chilling chamber 20 of the insulated hollow base 18. As the pressurized refrigerant cartridge 24 is engaged to the cartridge chamber 28 such that the needle valve 30 punctures the pressurized refrigerant cartridge 24, the pressurized refrigerant contained within the pressurized refrigerant cartridge 24 is permitted to escape therefrom and pass through the needle valve 30 into the chilling chamber 20. The pressurized refrigerant then fills the chilling chamber 20 and travels up the sleeveway 14 until reaching the beverage container 16. The temperature of the beverage container 16 is thus decreased, and maintained at this decreased temperature for an extended period of time by the insulative properties of the insulated wall 12.

What is claimed is:

1. A beverage chilling and insulating device for lowering the temperature of a beverage container and maintaining said lowered temperature, comprising:

a) an insulated sleeve having a top end and opposite bottom end, the top end open for accepting a beverage container;

b) a sleeveway defined by said insulated sleeve, said sleeveway sized to accept the beverage container;

c) an insulated hollow base secured to the bottom end of the insulated sleeve;

d) a chilling chamber defined by the insulated hollow base, said chilling chamber in communication with the sleeveway;

e) a cartridge receptacle hole located upon the insulated hollow base, said cartridge receptacle hole extending inward into the insulated hollow base to form a cylindrical cartridge chamber, the cartridge chamber having a series of threads disposed upon the inner surface thereof;

f) a pressurized refrigerant cartridge which contains a highly pressurized volume of refrigerant, said cartridge cylindrical and elongated in shape and having threads disposed upon an end thereof, said threads corresponding to the threads of the cartridge chamber so that said pressurized refrigerant cartridge may be securely engaged within the cartridge chamber; and g) a needle valve located in the cartridge chamber opposite the cartridge receptacle hole, said needle valve extending from the cartridge chamber into the chilling chamber, whereby a beverage container is inserted into the sleeveway, and upon engagement of the pressurized refrigerant cartridge into the cartridge chamber, the needle valve punctures the pressurized refrigerant cartridge, allowing the pressurized refrigerant contained therein to escape from the pressurized refrigerant cartridge through the needle valve and into the chilling chamber and sleeveway which is in communication therewith, the refrigerant then lowering the temperature of the beverage container, the beverage container maintained at this decreased temperature for an extended period of time by the insulative properties of the insulated wall.

2. The beverage chilling and insulating device of claim 1, wherein the insulated sleeve is comprised of polystyrene foam.

3. The beverage chilling and insulating device of claim 2, wherein the pressurized refrigerant contained within the pressurized refrigerant cartridge consists of nitrogen which is in a liquid state.

* * * * *